United States Patent [19]

Fisher, Jr. et al.

[11] 4,379,485

[45] Apr. 12, 1983

[54] WET/DRY STEAM CONDENSER

[75] Inventors: Warren H. Fisher, Jr., Parsippany; Barry M. Barnet, Morris Plains, both of N.J.

[73] Assignee: Foster Wheeler Energy Corporation, Livingston, N.J.

[21] Appl. No.: 252,546

[22] Filed: Apr. 9, 1981

[51] Int. Cl.[3] ..... F28B 1/02; F28B 1/06

[52] U.S. Cl. ..... 165/110; 165/DIG. 1; 261/153; 261/DIG. 11

[58] Field of Search ..... 165/110, DIG. 1; 261/153, DIG. 11

[56] References Cited

U.S. PATENT DOCUMENTS 3,885,936 5/1975 Limebeer ..... 261/DIG. 11
3,887,666 6/1975 Heller et al. ..... 261/DIG. 11
4,149,588 4/1979 Waters ..... 165/110 X
4,226,282 10/1980 Kunzagi et al. ..... 165/110 X

*Primary Examiner*—Albert W. Davis, Jr.
*Attorney, Agent, or Firm*—Marvin A. Naigur; John E. Wilson; Warren B. Kice

[57] ABSTRACT

A wet/dry steam condenser in accordance with the present invention includes two spaced-apart, vertically aligned groups of heat pipes with each group having the lower, evaporator sections of their respective heat pipes exposed to the interior of an associated, longitudinally extending steam-receiving plenum. The upper condensing section of each heat pipe is cooled by a fan-induced air flow and has a portion that is finned. The other portion of the condensing section of each pipe is cooled by deluge water from either a flood water trough and/or a spray-head assembly in addition to being cooled by a fan-induced air flow.

16 Claims, 3 Drawing Figures

WET/DRY STEAM CONDENSER

BACKGROUND OF THE INVENTION

The present invention relates to wet/dry steam condensers and, more particularly, to condensers which utilize heat pipes having an evaporator section exposed to the steam to-be-condensed and a condensing section cooled by either a cooling air-flow and/or a cooling water-flow.

In the steam power-generation cycle, the exhaust steam from the turbines(s) is generally passed through one or more surface-type heat exchanging condensers to remove the heat energy from the steam and effect condensation. A variety of heat exchanging condensers, including the wet-type, the dry-type, and combinations thereof, are known for effecting steam condensation. In the wet-type, the steam is passed along one side of a heat transfer surface, such as the wall section of a tube, and a heat receiving fluid (e.g., water) is passed along the other side. In the dry-type, air, rather than water, is passed over the heated surface to absorb the heat from the steam. The heated surface of the dry-type condenser generally include fins or fin-like structures that increase the heat transfer characteristics and the efficiency of the condenser. In the combined-type of steam condenser, heat energy from the steam may be selectively transferred to the air, and/or water.

Water and air, when used as the heat receiving fluids, each possess certain drawbacks which can hinder the efficient condensation of steam. For example, the quantity of water required by wet-type heat exchangers can be quite large, and, occasionally, water in sufficient quantities and of a minimum acceptable quality may not be available on a consistent year-round basis. Also, the water is heated as it passes through the heat exchanger, and the heated water can cause thermal pollution when it is returned to the environment. Air, while abundantly available, has a low heat capacity, density, and heat transfer rate and requires the use of large, power-consuming fans to create the cooling air-flows.

In the past, efforts have been made to increase steam condenser efficiency by fabricating condensers using heat pipes or thermal siphons. These condensers have included a plurality of heat pipes having their lower, evaporator sections exposed to the steam to-be-condensed and their upper, condenser sections exposed to an ambient, cooling air-flow. While heat-pipe steam condensers are effective, their overall heat transfer rates in relation to their capital cost have yet to be optimized.

SUMMARY OF THE INVENTION

In view of the problems associated with conventional steam condensers and the heat transfer advantages associated with heat pipes, it is a broad, overall object, among others, of the present invention to provide a steam condenser suitable for use in steam power-generating cycles in which the heat energy in the steam is quickly transferred from the steam to a heat receiving fluid via heat pipes.

It is another object of the present invention to provide a steam condenser in which the heat energy in the steam is quickly transferred from the steam and selectively transferred to a cooling air-flow and/or a cooling water-flow.

It is another object of the present invention to provide a steam condenser in which the heat energy in the steam can be quickly and efficiently transferred from the steam and selectively transferred to a cooling air and/or cooling water flow in which the cooling water-flow will not degrade the heat transfer characteristics of any extended heat transfer surfaces designed to increase the heat transfer rate to the cooling air.

In accordance with these objects, and others, the present invention provides a steam condenser which includes a plurality of substantially vertically aligned heat pipes preferably arranged in spaced-apart row formations in which the lower, evaporator section of each heat pipe is exposed to the interior of a steam-receiving plenum. The condenser sections of the heat pipes above the steam plenum is divided into an upper, finned zone and a lower zone. A deluge water supply system, including a flood water trough and a spray head assembly is provided to selectively apply a flow of cooling water to the lower zone of the condensor sections of the heat pipes, and a cooling air-flow inducing means is provided to selectively supply a flow of cooling air to both the upper and lower zones of the condenser sections of the heat pipes.

The heat energy in the steam is quickly transferred from the steam in the steam plenum to the upper portions of the heat pipes where the heat energy is conducted through the wall of the heat pipes and transferred to either the cooling water-flow and/or the cooling air-flow. The application of the cooling water flow to the lower portions of the condenser sections of the heat pipes prevents the water from depositing water-borne materials or the like on the fin structures of the upper, finned condenser sections of the heat pipes and causing a deterioration of the heat transfer characteristics of the condenser.

BRIEF DESCRIPTION OF THE DRAWINGS

The above description, as well as the object, features, and advantages of the present invention will be more fully appreciated by reference to the following detailed description of a presently preferred but nonetheless illustrative embodiment in accordance with the present invention, when taken in conjunction with the accompanying figures in which.

DESCRIPTION OF THE PREFERRED EMBODIMENT

Figure 1:
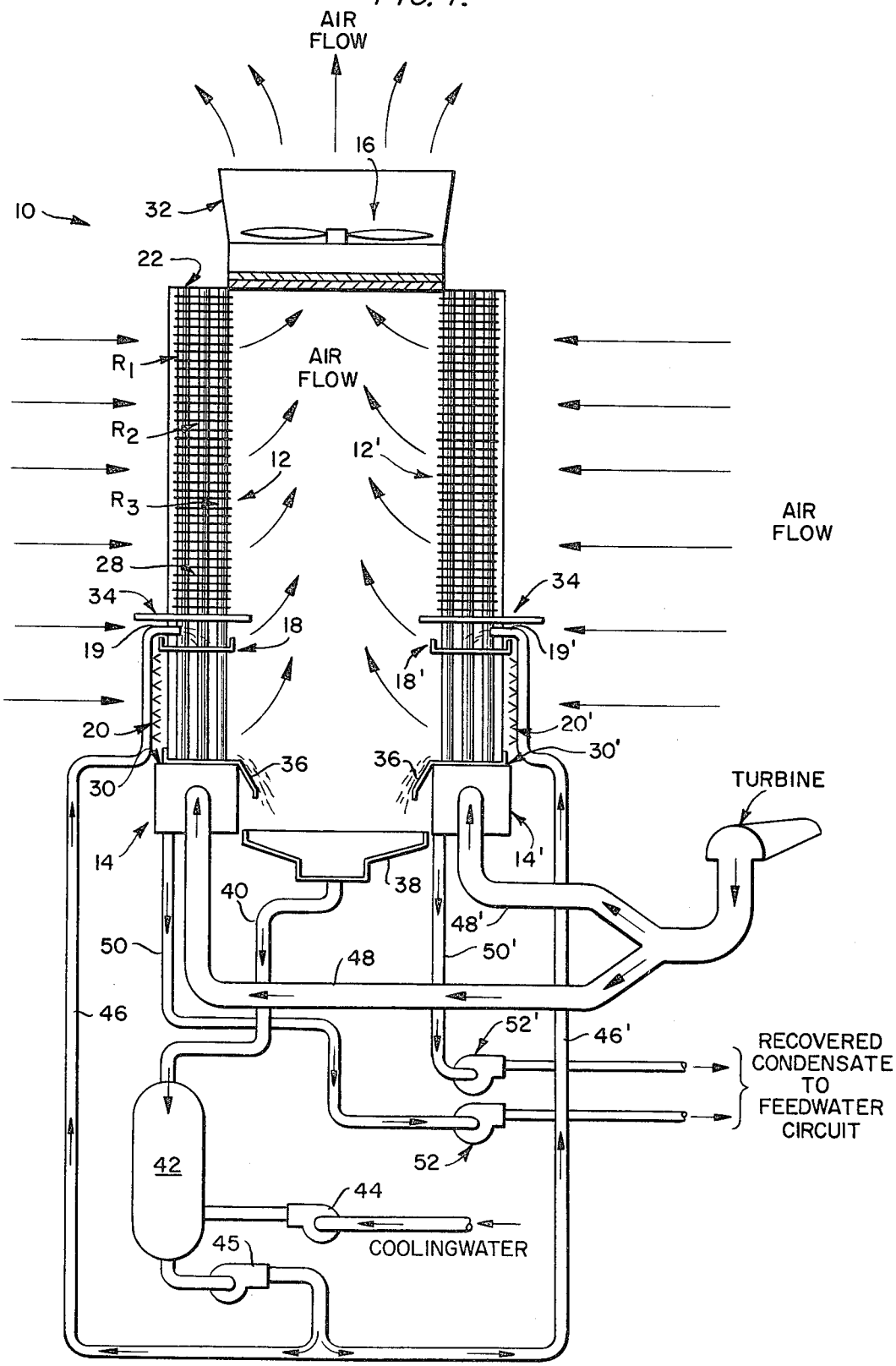
FIG. 1 is a front elevational view of a wet/dry steam condenser in accordance with the present invention.
Figure 2:
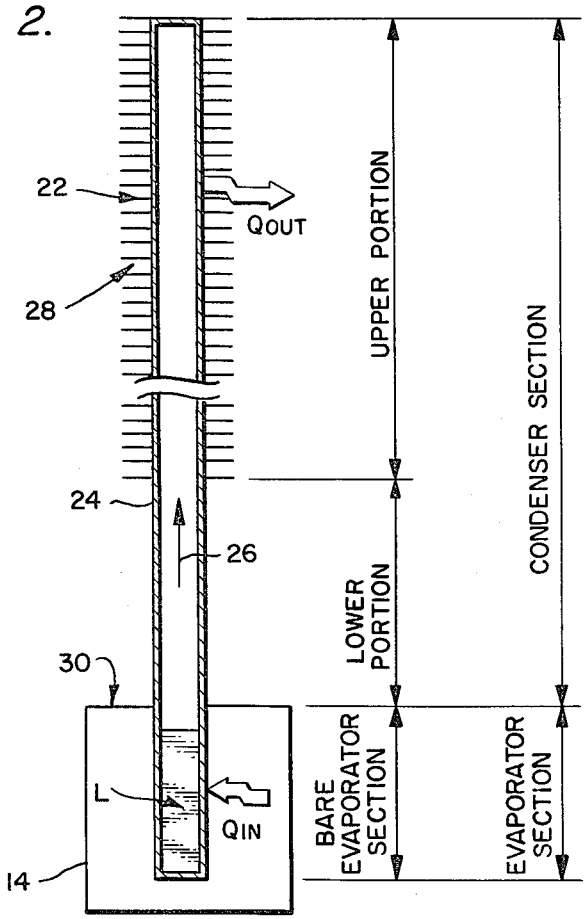
FIG. 2 is an enlarged elevational view, in cross-section of a typical heat pipe in the steam condenser of FIG. 1.

A wet/dry steam condenser in accordance with the present invention is generally represented by the reference character 10 in the figures and includes, as shown in FIG. 1, two spaced-apart heat-pipe groups 12 and 12', steam plenums 14 and 14', a cooling-air fan 16, and a cooling-water deluge system which includes flood water troughs 18 and 18' and spray-head assemblies 20 and 20'. The heat pipe groups 12 and 12' are each formed from a plurality of substantially vertically aligned heat pipes 22 which may be conveniently arranged in parallel rows, for example three rows, $R_1$, $R_2$, and $R_3$, as shown in FIG. 1. The heat pipes 22 are of conventional design in that they are fabricated, as shown in FIG. 2, from straight, hollow tubes 24 which are sealed at both ends. Each tube 24 contains a selected quantity of a heat transfer liquid L (e.g., ammonia) at a selected vapor pressure. The liquid L collects in the lower portion of each tube 24, termed the evaporator section, and is adapted to vaporize in response to heat energy ($Q_{in}$) introduced into the evaporator. The vapor rises upwardly in the tube, as indicated by the arrow 26 in FIG. 2, and condenses in the upper portion of each tube, termed the condenser section, relinquishing its heat energy ($Q_{out}$), with the condensate falling under the influence of gravity to the evaporator section.

As shown in FIGS. 1 and 2, the evaporator section of each heat pipe 22 passes through an upper surface 30 of the box-like, longitudinally extending steam-receiving plenums 14 and 14'.

An upper portion of the condenser section of each heat pipe 22 is provided with a plurality of fins extending outwardly of the tube surfaces to provide an extended heat transfer surface. The fins, which are schematically represented in FIG. 1 and FIG. 2 by the vertically spaced, horizontal lines 28, may take any one of a number of surface configurations including but not limited to spines, longitudinal fins, spiral fins, or disc-like fins. According to a preferred embodiment, the lower portion of the condenser section of each heat pipe 22, that is, a portion extending between the upper surface 30 of the plenums 14 and 14' and the finned portion is left bare or unfinned. Alternatively, these sections could be provided with specially formed fins which would be designed in accordance with the operating parameters, to be described later.

The horizontally disposed fan 16 spans the space between the two heat-pipe groups 12 and 12' and serves to induce a cooling air-flow by drawing ambient air laterally inward from the sides of the groups and directing the air upwardly through an exhaust hood 32 as shown by the air-flow arrows in FIG. 1.

The cooling-water deluge system is designed to selectively augment the cooling effect provided by the fan 16. The flood water troughs 18 and 18' are located between the lower and upper portions of the condenser sections of the heat pipes 22, with each trough having a plurality of thru-openings designed to accommodate the heat pipes. The openings are somewhat larger than the outside diameter of the heat pipes 22 such that water entering the flood water troughs 18 and 18' from water supply spouts 19 and 19' will cascade downwardly along the outside surface of the heat pipes 22 to remove the heat energy. The spray head assemblies 20 and 20' are located laterally adjacent each heat-pipe group 12 and 12', respectively, and are adapted to direct a water spray onto the lower portions of the condenser sections of the heat pipes 22 in order to increase the overall supply of cooling water. While the spray head assemblies 20 and 20' have been shown located on the outside of the groups 12 and 12', and facing inwardly, they may be located in other positions and may, if preferred, be divided into spray head subassemblies. Control valves (not shown) are provided to enable independent operation of the flood water troughs 18 and 18' or the spray heads 20 and 20'. A separation baffle or shield 34 is located on each heat-pipe group 12 and 12' above the flood water troughs 18 and 18' and functions to prevent any of the cooling water from splashing upwardly onto the fin structures thereby preventing undesirable mineral deposition which can degrade the heat transfer characteristics of the fins.

A water-receiving spillway 36 is mounted on the upper surface of each steam plenum 14 and 14' and functions to collect the cooling water as it drains from the heat pipes 22 and direct the water into a collecting basin 38 located between the plenums. The cooling water in the basin 38 flows through a pipe 40 into a water treatment unit 42 which also receives make-up cooling water supplied through a pump 44 and which serves to maintain the quality of the cooling water by removing impurities. After the water is treated, it is recycled through a pump 45 and conduits 46 and 46' having suitable control valves (not shown) to the flood water troughs 18 and 18' and the spray head assemblies 20 and 20'.

As shown in FIG. 1, the condenser 10 is adapted to accept and condense steam exhausted from, e.g., a steam turbine. The exhaust steam is divided into two flows that are directed by conduits 48 and 48' to the steam plenums 14 and 14'. The presence of the steam in the plenums 14 and 14' causes the heat pipes 22 to initiate and maintain their vaporization/condensation cycle to remove heat from the steam and effect condensation. The condensate is collected in the lower portions of each plenum 14 and 14' and removed through condensate recovery conduits 50 and 50'. Pumps 52 and 52' assist in returning the recovered condensate to the feedwater circuit.

Figure 3:
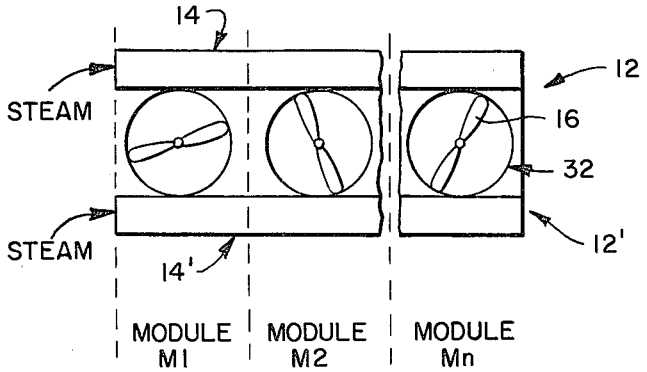
FIG. 3 is a reduced plan view of a portion of the steam condenser of FIG. 1 in accordance with the present invention.

The steam condenser of the present invention is preferably configured in modular form with the modules $M_1, M_2, \ldots M_n$ as illustrated in FIG. 3, linerally connected together, to form a complete steam condensing system. An exemplary steam condenser, designed to condense steam from a large steam turbine, would include two, parallel steam-plenums approximately 460 ft. (140 m.) long with 6,000 heat pipes extending upwardly from each plenum. The upper 50 ft. of the condenser section of each heat pipe would include fin surfaces; the lower 12 ft. of the condenser section would receive the deluge water and the evaporator section in the plenum would span 13 ft. Eighteen 32-ft. diameter fans, each of which defines a steam condensing module, are equally distributed along the length of the plenums and provide the cooling air flow. Depending upon the ambient air temperature and air flows, one or more of the fans are turned on to provide the required amount of induced cooling air-flow. As the ambient air temperature increases to a predetermined threshold temperature, e.g., 55° F. (10° C.), the deluge water system for one or more modules may be turned on to increase the heat transfer from the heat pipes. As the ambient air temperature rises, additional deluge water systems may be turned on.

The apparatus of the present invention provides a number of advantages when compared to conventional steam condensers. The heat energy from the steam may be conveniently transferred to the cooling air, and as required, selectively transferred to the cooling water. By providing the water augmentation system on a portion of the condenser section of each heat pipe, the problems associated with the mineral deposition and scaling on the finned condenser portion are avoided while maintaining the benefits associated with water augmented cooling.

As will be apparent to those skilled in the art, various changes and modifications may be made to the apparatus with the present invention without departing from the spirit and scope of the present invention, as recited in the appended claims and their legal equivalent.

What is claimed is:

1. A wet/dry steam condensing apparatus comprising:

a steam receiving plenum adapted to receive steam from a steam source;

a plurality of substantially vertically aligned, heat pipes, each of said heat pipes having an evaporator section extending in said plenum and adapted to receive heat energy from said steam, and a condensing section extending out of said plenum, each of said pipes containing a quantity of a heat transfer fluid adapted to transfer said heat energy from its evaporator section to its condensing section through a vapor/condensation cycle;

a separation baffle mounted on the condensing section of said heat pipes and dividing each section into two portions;

a plurality of fins disposed on a portion of the condensing section of each of said pipes; and cooling water application means operatively associated with the remaining portion of the condensing section of each of said pipes and adapted to selectively direct cooling water thereto.

2. A wet/dry steam condensing apparatus comprising:

a steam receiving plenum adapted to receive steam from a steam source;

a plurality of substantially vertically aligned, heat pipes, each of said heat pipes having an evaporator section extending in said plenum and adapted to receive heat energy from said steam, and a condensing section extending out of said plenum, each of said pipes containing a quantity of a heat transfer fluid adapted to transfer said heat energy from its evaporator section to its condensing section through a vapor/condensation cycle;

a plurality of fins disposed on a portion of the condensing section of each of said heat pipes;

a plurality of spray heads adapted to direct a spray of cooling water onto the remaining heat pipe portions; and a flood water trough located on said remaining heat pipe portions and adapted to receive cooling water and flow the water downwardly onto said remaining heat pipe portions of said heat pipes.

3. A wet/dry steam condensing apparatus comprising:

a steam receiving plenum adapted to receive steam from a steam source;

a plurality of substantially vertically aligned, heat pipes, each of said heat pipes having an evaporator section extending in said plenum and adapted to receive heat energy from said steam, and a condensing section extending out of said plenum, each of said pipes containing a quantity of a heat transfer fluid adapted to transfer fluid adapted to transfer said heat energy from its evaporator section to its condensing section through a vapor/condensation cycle;

each condensing section having an upper finned portion and a lower unfinned portion; and cooling water application means operatively associated with the lower unfinned portion of the condensing section of each of said pipes and adapted to selectively direct cooling water thereto.

4. The wet/dry steam condensing apparatus claimed in claim 1 or 2 wherein said remaining portion of the condensing section of each pipe is unfinned.

5. The wet/dry steam condensing apparatus claimed in claim 4 wherein said finned portion is located at an upper portion of the condensing section of each heat pipe and said unfinned portion is located at a lower portion of the condensing section of each heat pipe.

6. The wet/dry steam condensing apparatus claimed in claim 1, 2 or 3 wherein said heat pipes are arranged in two spaced-apart heat pipe groups, each of said groups associated with a steam plenum.

7. The wet/dry steam condensing apparatus claimed in claim 1, 2 or 3 wherein said heat pipes are arranged in a plural, parallel row formation.

8. The wet/dry steam condensing apparatus claimed in claim 2 or 3 comprising a cooling water separation baffle mounted on said heat pipes and separating said first heat pipe portions from said remaining heat pipe portions.

9. The wet/dry steam condensing apparatus claimed in claim 1 or 2 wherein said cooling water application means comprises a flood water trough located on said remaining heat pipe portions and adapted to selectively receive cooling water and flow the water downwardly onto the unfinned surfaces of said heat pipes.

10. The wet/dry steam condensing apparatus claimed in claim 9 wherein said cooling water application means further comprises water spray means including a plurality of spray heads adapted to direct a spray of cooling water onto said remaining heat pipe portions.

11. The wet/dry steam condensing apparatus claimed in claim 1 or 2 wherein said cooling water application means further comprises water spray means including a plurality of spray heads adapted to direct a spray of cooling water onto said remaining heat pipe portions.

12. The wet/dry steam condensing apparatus claimed in claim 1 or 2 further comprising fan means adapted to induce a flow of cooling air across the condensing sections of said heat pipes.

13. The wet/dry steam condensing apparatus claimed in claim 12 further comprising a hood assembly adapted to direct the cooling air flow from said fan means.

14. The wet/dry steam condensing apparatus claimed in claim 1, 2 or 3 wherein said apparatus is arranged in modular form, each of said modules adapted to be connected to one another to constitute a steam condensing system.

15. The wet/dry steam condensing apparatus claimed in claim 1, 2 or 3 further comprising a water receiving spillway positioned relative to said heat pipes to receive at least a portion of the water applied to said heat pipes by said cooling water application means.

16. The wet/dry steam condensing apparatus claimed in claim 15 further comprising a cooling water recycling system including a water treatment unit adapted to receive water from said spillway and return said water to said cooling water application means.

* * * * *